United States Patent [19]

Malacheski et al.

[11] 4,147,273

[45] Apr. 3, 1979

[54] RADIATOR VALVED CLOSURE

[76] Inventors: Joseph J. Malacheski; Richard J. Zenda, both of 32 Warner St., Plains, Pa. 18705

[21] Appl. No.: 901,474

[22] Filed: May 1, 1978

[51] Int. Cl.[2] ..... B65D 51/16

[52] U.S. Cl. ..... 220/204; 220/206; 220/DIG. 32

[58] Field of Search ..... 220/202, 203, 204, 206, 220/303, DIG. 32

[56] References Cited

U.S. PATENT DOCUMENTS

| | | | |
|---|---|---|---|
| 3,186,580 | 6/1965 | Previte | 220/206 |
| 3,203,445 | 8/1965 | McCormick | 220/206 X |
| 4,036,399 | 7/1977 | Gerdes | 220/303 |

*Primary Examiner*—George T. Hall
*Attorney, Agent, or Firm*—Robert K. Youtie

[57] ABSTRACT

The specification discloses a valved closure for a heat exchanger, such as the radiator of a liquid cooled vehicle engine, such radiators usually having an upper liquid chamber with an upstanding, flanged filling neck. The valved closure includes an annular adaptor on the upper end of the filling neck and having a valve seat, upstanding guide bearings on opposite sides of the adaptor, a valve element having a spherically curved portion in sealing engagement with the seat and having a through passageway generally chordally of the spherical portion and rotatable to shift the passageway into communication with the neck, aligned shafts extending from the valve element for rotation in respective guide bearings with the valve element when the latter changes position, and resilient tension means connected between the shafts and adaptor to urge the valve element into its seat sealing relation.

10 Claims, 5 Drawing Figures

RADIATOR VALVED CLOSURE

BACKGROUND OF THE INVENTION

As is well known to those versed in the automotive art, presently available radiator caps are subject to certain serious difficulties, including the danger of being burned by hot pressurized radiator fluid, the difficulty in removing and replacing the cap even in the absence of hot fluid, the ever present likelihood of non-replacement and loss, and others.

SUMMARY OF THE INVENTION

Accordingly, it is an important object of the present invention to provide a valved radiator closure which substantially obviates the hazard of injury from hot radiator fluid, is extremely easy to open and close as for inspection and maintenance, always remains in position on the radiator fill neck to avoid inadvertent removal and loss, accurately maintains desired radiator pressure, and is extremely simple in structure for reliability throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
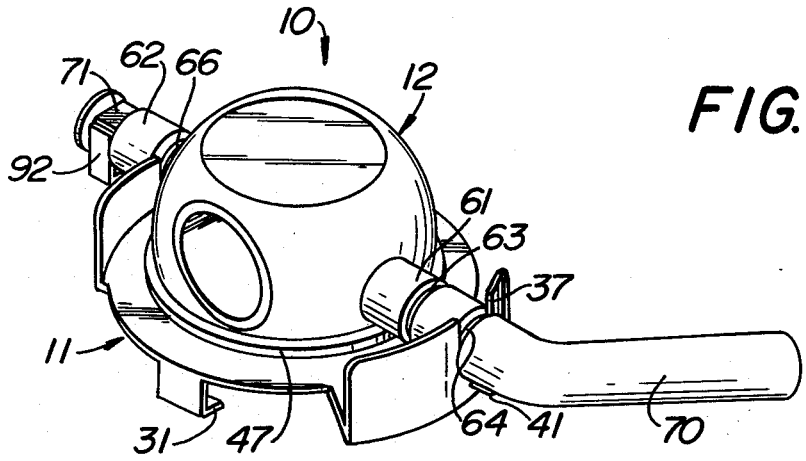
FIG. 1 is a top perspective view showing a valved radiator closure of the present invention in closed condition and apart from a radiator.

Referring now more particularly to the drawings, and specifically to FIG. 1 thereof, a valved radiator closure or cap is there generally designated 10, and includes a generally circular or annular adaptor 11 and a valve element 12 rotatably seated on the adaptor.

Figure 3:
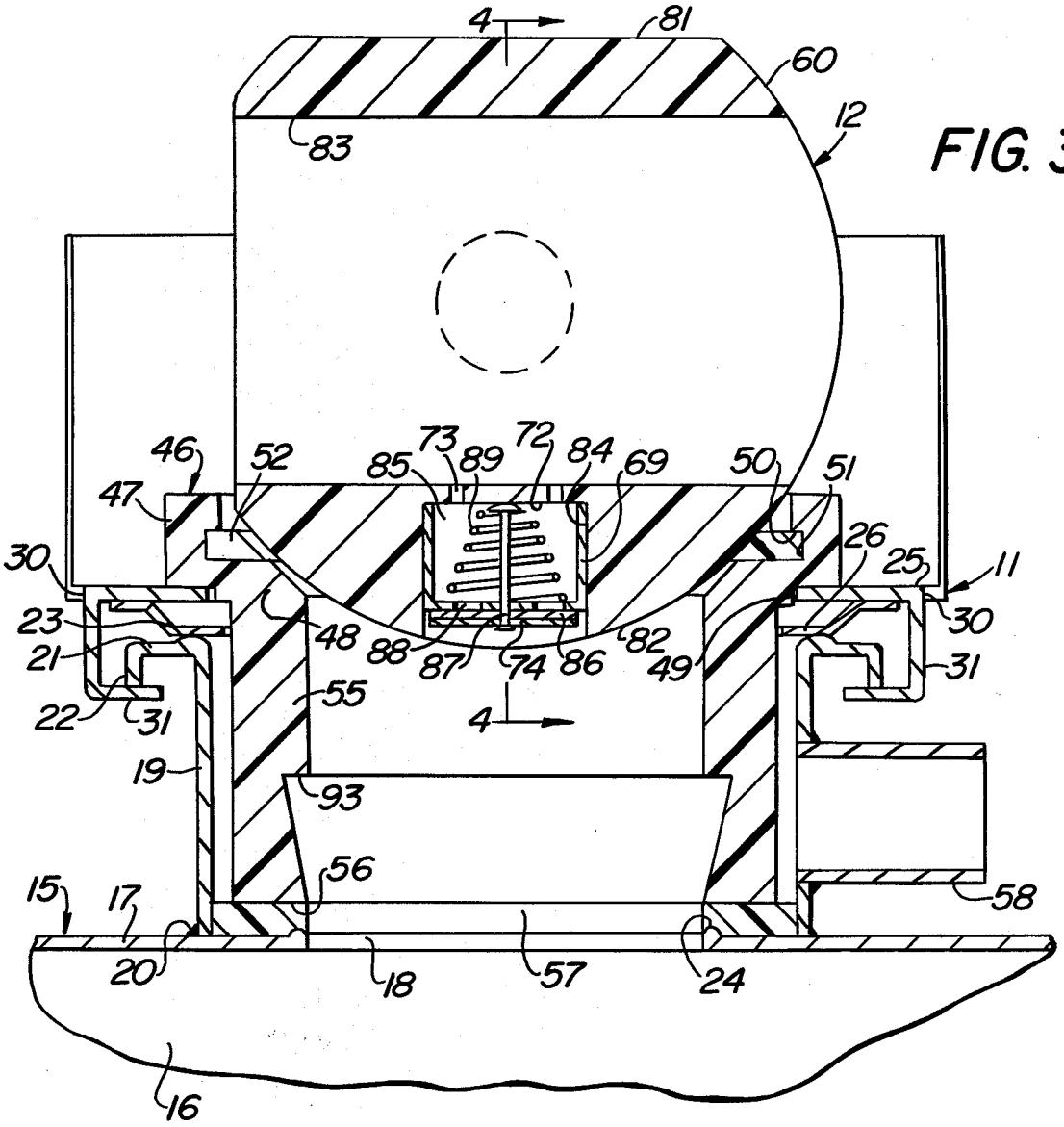
FIG. 3 is a sectional view taken generally along the line 3—3 of FIG. 2, and illustrating the valved closure in association with a heat exchanger.

As best seen in FIG. 3, a conventional heat exchanger or radiator is generally designated 15, and may have an upper radiator fluid chamber 16, having an upper chamber wall 17. The upper or top wall 17 or radiator chamber 16 may have a through opening 18 provided circumferentially about its upper or outer side with a sealing bead 24. Upstanding from the chamber top wall 17, concentric with and spaced circumferentially about the hole 18 is a tubular spout or filler neck 19, being suitably secured to the wall 17, as by circumferential welding or brazing 20. The filler neck is provided about its upper end with a circumferentially extending outstanding flange 21, which may include a depending lip 22. The upper side of flange 21 may be circumferentially raised to define a sealing rib or bead 23. This radiator and filler neck structure may be generally conventional.

The adaptor 11 may include a generally annular, substantially circular member or plate 25 adapted to be concentrically superposed over the upper end of filler neck 19. Further, the adaptor ring or annulus 25 may be provided on its underside with a resilient sealing flange 26 for sealing engagement with the rib or bead 23.

Figure 2:
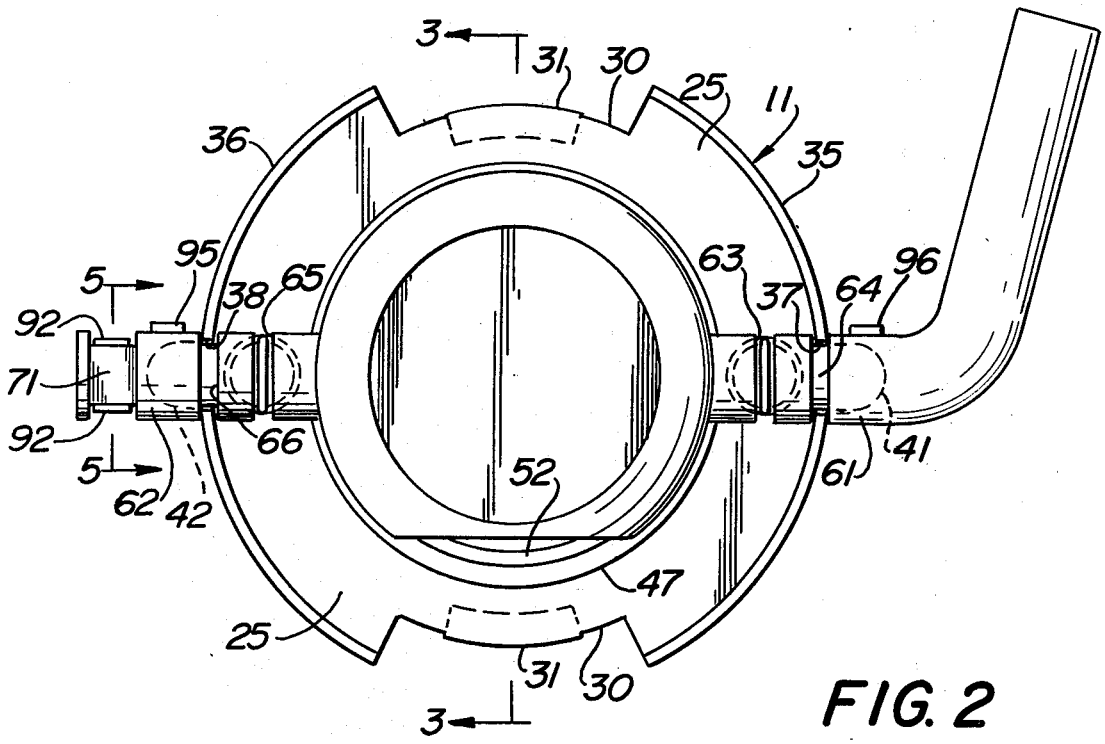
FIG. 2 is a top plan view of the valved closure of FIG. 1.

At spaced locations about the adaptor ring 25, say diametrically opposed locations, there may be formed radially inwardly extending cutouts, as at 30, best seen in FIG. 2, which may be provided with depending inturned retainer formations or clips 31 for engagement beneath the depending flange lip 22 to secure the adaptor 11 in position on the neck 19 with the adaptor sealing flange 26 in resilient sealing engagement with the neck sealing bead 23. This structure may be similar to that found in presently existing radiator caps, the depending lip 22 having declining lower edges, or other suitable means to insure effective sealing engagement between flange 26 and bead 23.

Upstanding from the outer edge of adaptor ring 25, at opposite sides thereof, say between the cutouts 30, may be a pair of upstanding arcuate walls or protective shields 35 and 36. The upstanding walls 35 and 36 may be generally concentric with the adaptor ring 25, being diametrically opposed with respect to each other, and each formed with an upwardly opening guide notch or cutout, as at 37 and 38, respectively. The guide notches 37 and 38 are in diametric alignment with each other with respect to the adaptor 11 and may be of generally U-shaped, upwardly open configuration, as illustrated. In addition, below each guide cutout or notch 37 and 38, the respective wall 35 and 36 is formed with half-moon cut, as at 39 and 40 in FIG. 4, the material thereof being struck outwardly therefrom to define respective outstanding ledges or shelves 41 and 42.

In addition, the adaptor ring 25 is provided, adjacent to and inwardly of each guide notch or cutout 39 and 40 with a struck-up portion or hook, as at 43 and 44.

Thus, the adaptor 11 may be removably placed on the upper end of flange fill neck 19, generally in the same manner as a conventional radiator cap. However, as will become apparent more fully hereinafter, the adaptor 11 need not be frequently removed, as in the prior art.

A generally annular insert is generally designated 46, and engaged concentrically of and centrally within the adaptor ring 25. The insert 46 may include a circumferential portion 47 resting on the adaptor ring 25, entirely thereabout, and an inwardly and downwardly tapering or funnel portion 48 extending in downwardly convergent relation through the central opening or hole 49 of the adaptor ring 25. The circumferential portion 47 may have its internal surface undercut, as at 50, to define an internal annular groove 51, in which is engaged a valve seat 52, for a purpose appearing presently.

Extending downwardly from the lower end of insert funnel portion 48 is a generally cylindrical or tubular, depending extension 55, which may terminate at its lower end 56 spaced over the sealing bead 24. Interposed between the lower end of depending extension 55 and sealing bead 24 is a relatively compressible sealing ring or washer 57.

Intermediate the upper and lower ends of fill neck 19, there is provided therein an overflow outlet or tube 58 communicating between the interior of the fill neck and the exterior thereof, say to an overflow container, if desired.

The valve element 12 may be constituted of a generally spherical body or ball 60 disposed concentrically over the adaptor 11. Outstanding radially from diametrically opposed locations on the valve element or ball 60 are a pair of stub shafts or pins 61 and 62 extending respectively through cutouts 37 and 38. The stub shaft 61 is provided with a pair of spaced circumferential grooves 63 and 64, as is the stub shaft 62 similarly provided with a pair of spaced circumferential grooves 65 and 66. The grooves 64 and 66 are outward of grooves 63 and 65, respectively, which outer grooves are respectively disposed within guide notches or cutouts 37 and 38, loosely receiving the respective edge margins thereof, as may be seen in FIG. 2. Thus, the cutouts or guide notches 37 and 38 may be seen to constrain the valve element 12 and its spherical body or ball 60 to rotation about the aligned axes of shafts 61 and 62 and vertical up and down movement.

The outer end of stub shaft 61 may be provided with a transverse extension, crank or arm 70, as for manually actuating rotation of the ball 60. The distal end of stub shaft 62 may be provided with a polygonal cross-sectional region 71, say of square cross-section.

Figure 4:
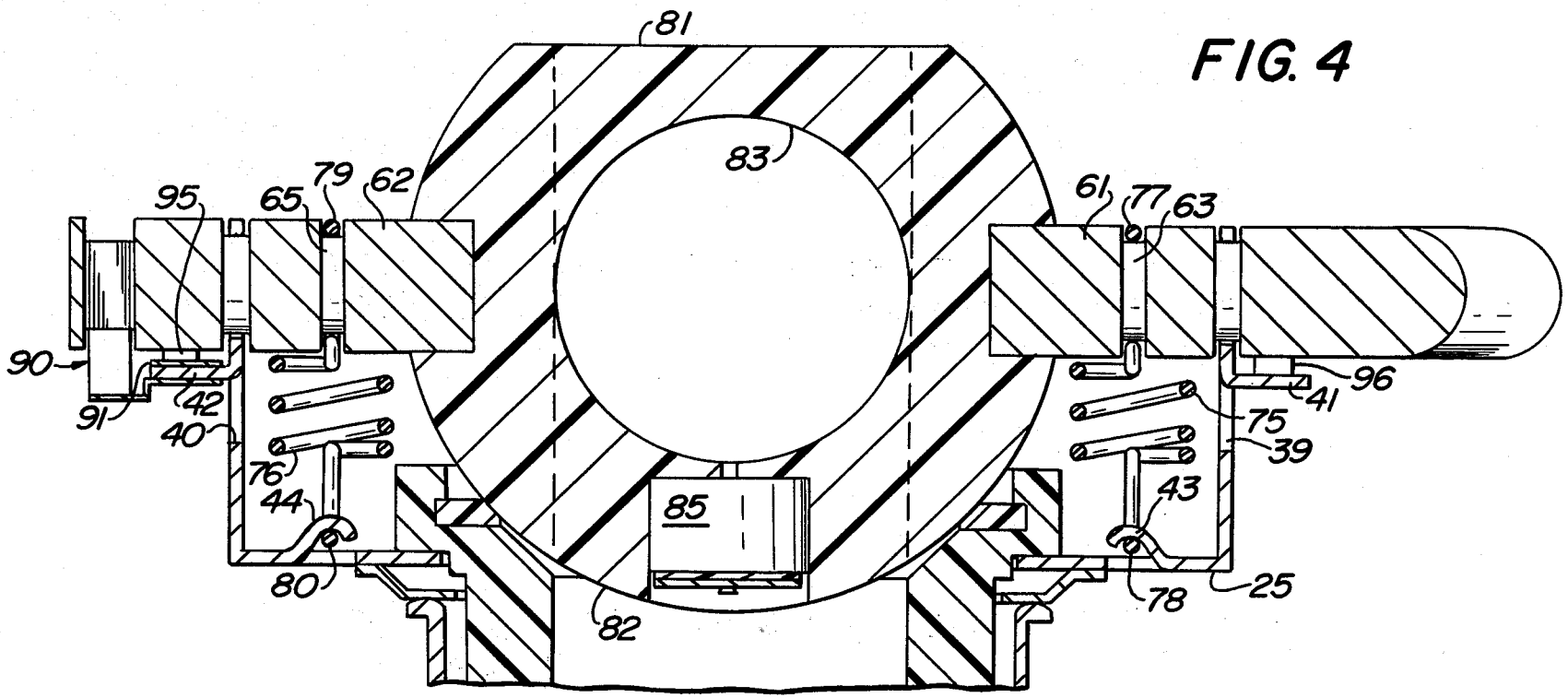
FIG. 4 is a sectional elevational view taken generally along the line 4—4 of FIG. 3.

As best seen in FIGS. 3 and 4, the spherical valve body or ball 60 is shown seated in sealing, closing relation with the valve seat 52. In this condition, the shafts 61 and 62 extend through respective guide notches 37 and 38 with clearance between the undersides of the shafts and the lower regions of the guide notches, so that the body 60 is free to move downwardly into sealing engagement with the seat 52.

In order to yieldably maintain this sealing engagement of body 60 with seat 52, there are provided a pair of coil tension springs 75 and 76 respectively yieldably urging shafts 61 and 62 downwardly. In particular, tension spring 75 has an upper end loop 77 engaged over shaft 61 in groove 63, and has its lower end loop 78 hooked to nether hook 43. Similarly, tension spring 76 includes an upper end loop 79 engaged over shaft 62 in groove 65, and has a lower end loop 80 interhooked with nether hook 44. It is by these resiliently downwardly urging springs 75 and 76 that body or ball 60 is maintained in sealing engagement with seat 52. Also, the downward urgence of springs 75 and 76 serves through insert 46 to maintain the seal or washer 57 in sealing interposition between the depending extension 55 and sealing bead 24, all against the upward force of pressurized fluid from within the chamber 16, as will appear more fully hereinafter.

In the illustrated embodiment, the generally spherical body or ball 60 may have a generally circular flat area 81 uppermost, in the position shown in FIGS. 3 and 4. A generally spherical lower surface, opposite to the flat area 81, is designated 82, and is in conformable sealing engagement with seat 52. Extending generally chordally with respect to the spherical surface portion 81, generally horizontally in the illustrated position, and intersecting with the aligned axes of shaft or pin 61 and 62, is an open-ended through bore or passageway 83. In addition, a blind bore or passageway 84 is formed in the ball or body 60 extending generally normal to the passageway 83, upwardly and inwardly as seen in the illustrated position, through the spherical surface portion 82 and terminating in an end wall 72 short of passageway 83. Communicating through end wall 72 between passageway 83 and 84 are ports 73. The bore 84 is provided with a one-way valve 85 serving to permit the passage of fluid only downwardly in a direction from passageway 83 through passageway 84 to the interior of tubular extension 55. The one-way valve member 85 may include a generally cylindrical valve housing 69 fit in bore 84, and a valve element 86 shiftable downwardly with a shaft 87 from its illustrated closed position to an open position to pass fluid in the downward direction toward lower pressure. That is, the shiftable rod 87 may carry a valve element or crosshead 74, including a sealing washer 86, yieldably urged upwardly by spring 89 to a closed position closing valve openings 88, and is shiftable downwardly under predetermined pressured differential between the interior and exterior of chamber 16 to open the valve openings.

Thus, under conditions of sufficient vacuum within the radiator chamber 16, atmospheric air may pass through one way valve 85 into the radiator.

Release of internal pressure through overflow outlet 85 is aided by the provision of an inwardly facing pressure surface 93 which urged insert 46 upwardly with ball 60.

When it is desired to open the radiator, as for maintenance, say to replace fluid, it is only necessary to turn the crank or handle 70 90° to rotate the ball or body 60 90°, clockwise as seen in FIG. 3, to align passageway 83 with the interior of extension tube 55 for communicating between the interior and exterior of the radiator.

Figure 5:
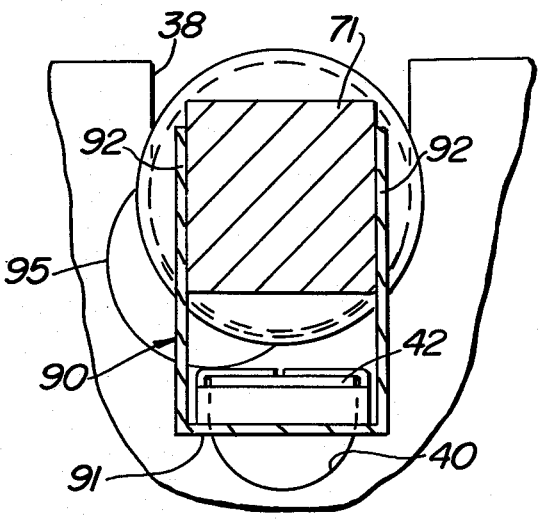
FIG. 5 is a partial sectional elevation view taken generally along the line 5—5 of FIG. 2.

A leaf spring assembly is generally designated 90, see FIG. 5, including a mounting bracket or clip 91 engaged about ledge 42 and extending therefrom beneath the polygonal shaft portion 71. Upstanding from the bracket 91 are resilient arms or leaves 92 for resiliently yieldably retaining engagement with opposed flats or polygonal shaft portion 71. Thus, the ball 60 and shafts 61 and 62 are deliberately rotatable between the closed position illustrated in FIG. 4, and the open position described hereinbefore 90° from the closed position, and are yieldably and releasably retained in both of these positions by the leaf assembly 90.

Additionally, the shaft 62 is provided at one location thereon with an external protrusion or cam 95 on one quadrant of the pin or shaft 62. In the closed position of valve element 12, the cam or protrusion 95 extends laterally or horizontally outwardly. A similar cam 96 is provided on shaft 61. However, upon rotation of the valve element to its open position the cams 95 and 96 swing downwardly into camming engagement with the ledges or shelves 42 and 41 to raise the ball or body 60 and initiate slight venting of the pressurized fluid from the radiator chamber 16 prior to full opening with the passageway 83 aligned with the tubular extension 55, as well as to prevent ball 60 from wearing or deforming seat 52 when the ball rotates.

Thus, it will now be appreciated that the valved closure 10 of the present invention serves to effectively retain the chamber 16 closed under a desired pressure, as afforded by the springs 75 and 76, while permitting of venting of excess pressure through outlet 58. Also, vacuum created in the chamber 16, as upon cooling, is vented by the admission of air into the chamber through one-way valve 85. The opposed side walls or shields 35 and 36 serve, not only to guide rotative and vertical movement of valve element or ball 60, but also to shield both an operator and the engine from a shower of pressurized radiator fluid.

From the foregoing, it is seen that the present invention provides a valved closure which is extremely simple in construction and operation, durable and reliable throughout a long useful life, and which otherwise fully accomplishes its intended objects.

Although the present invention has been described in some detail by way of illustration and example for purposes of clarity of understanding, it is understood that certain chamges and modifications may be made within the spirit of the invention.

What is claimed is:

1. In a heat exchanger, the combination comprising a liquid chamber having a top wall, a filling neck upstanding from and opening through said top wall, a flange on said neck, an annular adaptor for removable engagement over the upper end of the neck in interfitting relation with the flange, a pair of aligned upwardly opening pedestal bearings upstanding from opposite locations on said adaptor, an annular insert on said adaptor, an annular upwardly facing seat on said insert, a valve element having an exterior sealing region of spherical curvature engageable in sealing relation with said seat, said valve element having a through passageway extending generally chordally to said exterior sealing region, a pair of aligned shafts extending from opposite sides of said valve element and journaled in respective bearings to guide said valve element for rotation to shift said through passageway into communication through said neck with said chamber, and resilient means yieldably retaining said shafts downwardly in said bearings against internal pressure in said chamber.

2. The combination according to claim 1, in combination with a one-way vacuum release valve in said valve element communicating between said through passageway and said exterior sealing region for venting vacuum in said chamber.

3. The combination according to claim 1, in combination with cam means on at least one of said shafts for incrementally lifting the latter and said valve element upon rotation out of said sealing relation and before rotation into said chamber communication to gradually vent pressure from said chamber.

4. The combination according to claim 3, said cam means comprising a protuberance on one of said shafts outboard of its pedestal bearing, and an outstanding ledge on said adaptor beneath said one shaft engageable with said protuberance to initiate raising of said valve element.

5. The combination according to claim 1, in combination with an arm extending from one shaft for manual actuation of the latter and a shield upstanding about said one shaft for protection from pressurized fluid discharge.

6. The combination according to claim 1, the resilient means comprising at least one tension spring extending between one of said shafts and said adaptor.

7. The combination according to claim 1, in combination with a tubular extension depending from said insert into sealing engagement with said top wall, said neck being provided intermediate its end with an overflow outlet for communication with said chamber when said valve element, insert and tubular extension are raised by excess pressure to disengage said extension from said sealing engagement.

8. The combination according to claim 1, in combination with detent means for releasably holding said valve element in a selected position of its rotative movement.

9. The combination according to claim 8, said detent means comprising a leaf spring adjacent to and in resilient bearing engagement with one of said shafts, said one shaft having flats for engagement with said leaf spring with said valve element at said positions.

10. The combination according to claim 1, said shafts being spaced above the lower regions of said bearings to assure said valve element is maintained in said sealing relation with said seat by said resilient means.

* * * * *